US005469165A

United States Patent [19]

Milroy

[11] Patent Number: 5,469,165

[45] Date of Patent: Nov. 21, 1995

[54] RADAR AND ELECTRONIC WARFARE SYSTEMS EMPLOYING CONTINUOUS TRANSVERSE STUB ARRAY ANTENNAS

[75] Inventor: William W. Milroy, Playa Del Rey, Calif.

[73] Assignee: Hughes Aircraft Company, Los Angeles, Calif.

[21] Appl. No.: 173,291

[22] Filed: Dec. 23, 1993

[51] Int. Cl.[6] ..... H01Q 3/22

[52] U.S. Cl. ..... 342/13; 342/147; 342/371

[58] Field of Search ..... 343/772; 342/17, 342/149, 372, 13, 371, 147

[56] References Cited

U.S. PATENT DOCUMENTS

| | | | |
|---|---|---|---|
| 3,653,054 | 3/1972 | Wen | 343/772 |
| 4,882,587 | 11/1989 | Vodopia | 342/372 |
| 5,173,700 | 12/1992 | Chesley | 342/17 |
| 5,266,961 | 11/1993 | Milroy | 343/772 |

*Primary Examiner*—Mark Hellner
*Attorney, Agent, or Firm*—Leonard A. Alkov; W. K. Denson-Low

[57] ABSTRACT

Radar and electronic warfare systems comprising a variety of continuous transverse stub antenna arrays combined with a radar and electronic warfare subsystem. A passive one- or two-dimensional passive electronically scanned antenna radar system is provided when the continuous transverse stub antenna array is fabricated from voltage variable dielectric material. A two-dimensional active array radar system is provided when active array transmit/receive modules are used in conjunction with the voltage variable dielectric continuous transverse stub antenna array. The passive radar system include a continuous transverse stub antenna array, a transmitter, a receiver/exciter, an analog signal converter, a radar display, and a signal processor for processing received radar return signals to produce a radar image. A power supply provides power to the components. A high voltage power supply is provided to drive the voltage variable dielectric material to achieve beam scanning. The electronically scanned and active array radar systems use a voltage variable dielectric continuous transverse stub array. The radar system additionally comprises a plurality of discrete phase shifters coupled to the array. A beam steering computer sets the phase-shifters to steer a radar beam produced by the antenna array in the H-Plane to a desired pointing angle. he high voltage power supply steers the radar beam produced by the antenna array in its E-Plane. The continuous transverse stub array comprises a radiator, a cold plate, a plurality of transmit and receive modules including a feed air strip, a power filter and distribution printed wiring board, and a monopulse network for providing signal outputs that include a sum signal, an elevation signal, an azimuth signal, and a guard signal.

7 Claims, 4 Drawing Sheets

RADAR AND ELECTRONIC WARFARE SYSTEMS EMPLOYING CONTINUOUS TRANSVERSE STUB ARRAY ANTENNAS

CROSS-REFERENCE TO RELATED APPLICATIONS

Reference is made to copending U.S. patent application Ser. No. 07/751,282, filed Aug. 29, 1991, assigned to the assignee of the present invention, the contents of which are incorporated herein by reference.

BACKGROUND

The present invention relates generally to radar and electronic warfare systems, and more particularly, to radar and electronic warfare systems employing continuous transverse stub antenna arrays.

Currently fielded radar warning receivers (RWR) resolve emitter's angular location and motion at a very coarse quadrant level through passive reception of the emitter's signal. In particular, the angular resolution of a RF emitter is typically 22 degrees. Multiple emitters in the same quadrant could pose identification ambiguities for a radar warning receiver. In addition, accurate passive ranging information is not achievable with current radar warning receiver antennas. Detection of RF emitters with cross polarization relative to the radar warning receiver antenna is also not feasible.

In addition, deceptive electronic countermeasures (active transmission) must have the capability to jam multiple targets very rapidly. This requires the jammers to have a wide bandwidth and rapid response time. Currently, jammers are limited in bandwidth coverage and can only sequentially jam a limited number of RF emitters.

Planar array antennas are the closest prior art to non-scanning continuous transverse stub antennas. Continuous transverse stub antennas employed in the present invention has a cost and weight advantage over conventional planar array antennas. Conventional passive-electronically scanned antennas are the prior art for voltage variable dielectric continuous transverse stub electronically scanned antennas. The conventional antennas cost more, are heavier and have a larger depth dimension than continuous transverse stub electronically scanned antennas employed in the present invention. Also one-dimensional continuous transverse stub electronically scanned antennas are practical at much higher RF frequencies than conventional electronically scanned antennas. Continuous transverse stub electronically scanned antennas and continuous transverse stub active arrays are also more serviceable than conventional antennas because of their simple architecture.

It is therefore an objective of the present invention to provide for radar and electronic warfare systems that incorporate continuous transverse stub antenna arrays, and provide for improved performance over their conventional counterparts.

SUMMARY OF THE INVENTION

The present invention comprises a variety of continuous transverse stub antenna arrays combined with a radar and/or electronic warfare subsystem to form improved radar and electronic warfare systems. Although different in function and application, radar and electronic warfare systems impose similar requirements on the antenna subsystem. Radar antenna system will therefore be described with the intent of being generally applicable to electronic warfare systems.

When the continuous transverse stub antenna array is fabricated from voltage variable dielectric material, the radar system forms either a passive one- or two-dimensional passive electronically scanned antenna radar. When active array transmit/receive modules are used in conjunction with the voltage variable dielectric continuous transverse stub antenna array, it forms a two-dimensional active array radar system.

More particularly, the present invention provides for a radar system comprising a continuous transverse stub antenna array, a transmitter coupled to the continuous transverse stub antenna array, and a receiver/exciter coupled to the transmitter and the continuous transverse stub antenna array. An analog signal converter is coupled to the receiver/exciter. A radar display is provided, and a signal processor is coupled to the analog signal converter and the radar display for processing received radar return signals to produce a radar image that is displayed on the display. A power supply is coupled to the signal processor, the analog signal converter, and the receiver/exciter and transmitter for providing operational power thereto.

In one passive embodiment of the radar system, the continuous transverse stub array is substantially immobile. In another passive embodiment of the radar system, the continuous transverse stub array is mechanically scanned. The system elements used in the passive electronically scanned continuous transverse stub radar embodiment are substantially identical to those employed in a conventional passive electronically scanned radar subsystem, but with the addition of a high voltage power supply needed to drive the voltage variable dielectric material to achieve beam scanning in the E-plane.

An electronically scanned radar system is provided by the present invention by employing voltage variable dielectric material in the continuous transverse stub array. The radar system then additionally comprises a plurality of discrete phase shifters coupled to the continuous transverse stub antenna array. A beam steering computer is coupled between a radar data processor and the continuous transverse stub antenna array for setting the phase-shifters to steer a radar beam produced by the antenna array in the H-Plane to a desired pointing angle. A high voltage power supply is coupled to the continuous transverse stub antenna array for steering the radar beam produced by the continuous transverse stub antenna array in its E-Plane.

An active array radar system is provided by the present invention by employing voltage variable dielectric material in the continuous transverse stub array. The radar system then additionally comprises a receiver/exciter coupled to the continuous transverse stub antenna array, and an analog signal converter coupled to the receiver/exciter. A radar display is provided, and a radar data processor is coupled to the analog signal converter and the radar display for processing received radar return signals to produce a radar image that is displayed on the display. A power supply is coupled to the signal processor, the analog signal converter, and the receiver/exciter for providing operational power thereto. A plurality of discrete transmit/receive modules are coupled to the continuous transverse stub antenna array. A beam steering computer is coupled between the radar data processor and the continuous transverse stub antenna array for setting phase-shifters internal to each transmit/receive module to steer a radar beam produced by the antenna array in the H-Plane to a desired pointing angle. A high voltage power supply is coupled to the continuous transverse stub antenna array for steering the radar beam produced by the continuous transverse stub antenna array in its E-Plane. The high voltage power supply is the only addition to a conventional active array radar system needed when a continuous transverse stub active antenna array is used in place of a conventional active array.

The continuous transverse stub array typically comprises a plurality of layers that include a continuous transverse stub radiating plate, and a cold plate attached to the continuous transverse stub radiating plate. A plurality of transmit and receive modules including an air stripline feed are disposed adjacent to the cold plate. A power filter and distribution circuit (printed wiring board) is disposed adjacent to the plurality of transmit/receive modules. A monopulse network is coupled to the air stripline and provides signal outputs that include a sum signal, an elevation signal, an azimuth signal, and a guard signal.

Many of the advantages of the continuous transverse stub electronically scanned antenna and the continuous transverse stub active array employed in the present invention accrue from the distributed phase shifting capability of the voltage variable dielectric material used to fabricate the antenna array. This removes the conventional grating-lobe-elimination constraint that normally requires that discrete phase shifters or transmit/receive modules be spaced nominally every one-half wavelength in a two-dimensional grid over the surface of the array. The continuous transverse stub antenna array architecture requires discrete phase shifters in only one dimension. The number and spacing of the rows or columns of phase shifters for a continuous transverse stub electronically scanned antennas depends on the required power-aperture, instantaneous-bandwidth, and insertion loss of the radar system. Typically there are 10–25% of the number of discrete phase shifters or transmit/receive modules in a continuous transverse stub electronically scanned antenna or active array compared to conventional antenna architectures with commensurate benefits in terms of reduced complexity and cost.

Continuous transverse stub antenna arrays employed in the present invention may be designed to operate at almost any RF frequency. Tunable bandwidths for a continuous transverse stub electronically scanned antennas or continuous transverse stub active array are typically forty percent of the center frequency. The present invention may be employed with any aircraft radar, shipborne target tracking radar systems, particularly those with mast-mounted antennas, and ground-based target tracking radar systems. Commercial applications include adaptive cruise control radar systems and landing aid radar systems. The continuous transverse stub antenna may be used passively as a radar warning receiver or electronic support measures antenna to provide situation awareness and early warning of RF emitters.

The continuous transverse stub antenna has the capability to provide multi-octave RF coverage and dual polarization switching suitable for a wideband radar warning receiver or electronic support measures. Dual polarization switching capability can provide detection of RF emitters with different polarization. Highly accurate direction of arrival information may be obtained by feeding a reduced number of elements in the continuous transverse stub array. Accurate direction of arrival information greatly enhances a radar warning receiver's capability in resolving multiple targets in the same quadrant. In addition, elements of the continuous transverse stub antenna array may be designed to perform passive ranging functions of an interferometer. Passive ranging capability allows an aircraft to passively determine the range to the emitter without activating its own radar and alerting its own location to others. The light weight, low depth and conformal capability of the continuous transverse stub antenna allows placement of antennas on previously unavailable places on the platform.

The continuous transverse stub antenna array is inherently wideband and the dielectric material can respond rapidly to provide sequential jamming of multiple RF emitters. The light weight, low depth, conformal capability of the continuous transverse stub antenna allows airborne platforms to have all-aspect jamming capability and enhances platform survivability.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
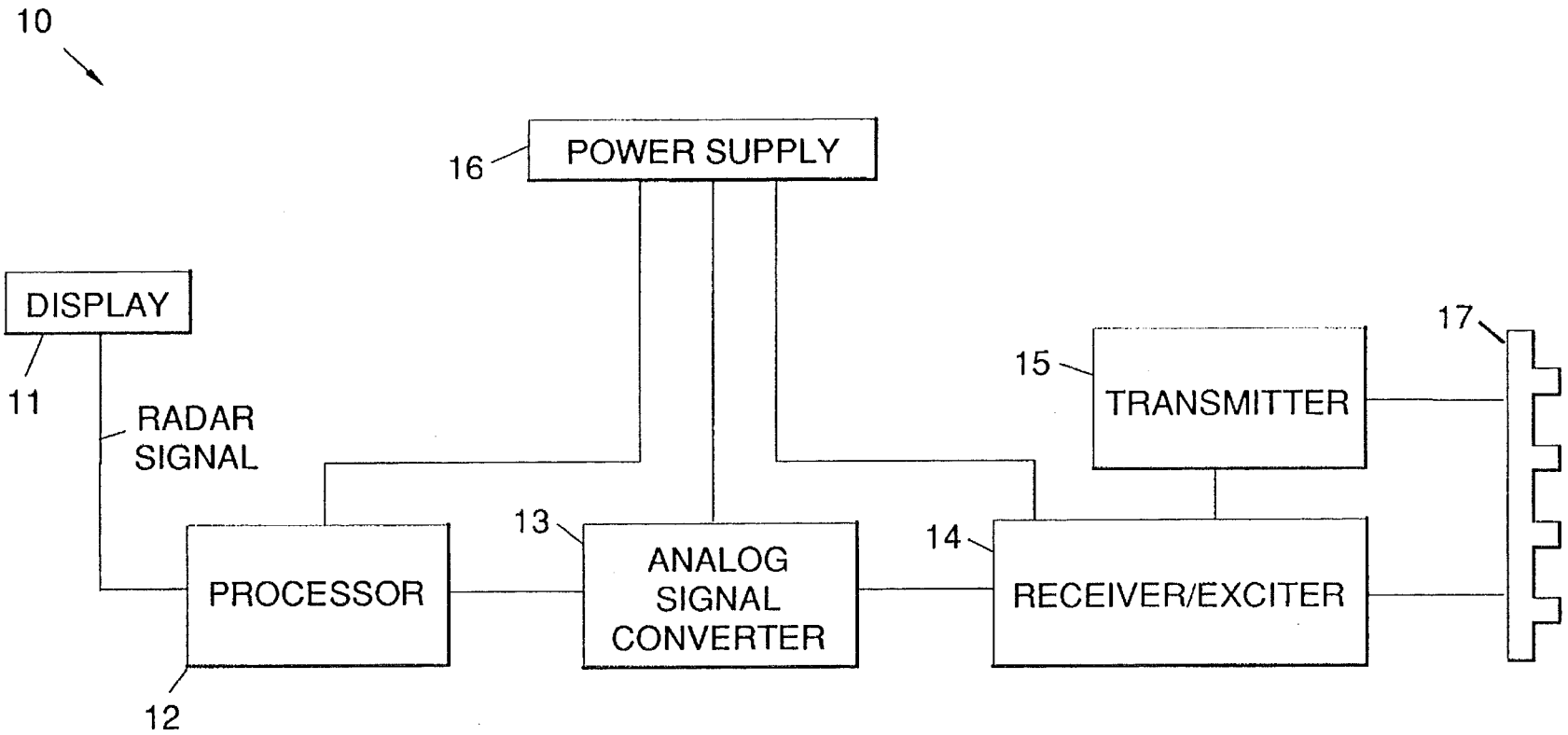
FIG. 1 shows a schematic diagram of a radar system using a nonscanning or mechanically scanned continuous transverse stub antenna system.

Referring to the drawing figures, FIG. 1 shows a schematic diagram of a radar system 10 using a nonscanning or mechanically scanned continuous transverse stub antenna array 17. The radar system 10 comprises a radar data processor 12, power supply 16, analog signal converter 13, a transmitter 15 and a receiver/exciter 14 and a continuous transverse stub antenna array 17. In the system configuration shown in FIG. 1, the continuous transverse stub array either remains immobile or is mechanically scanned. The processor 12, analog signal converter 13, transmitter 15, receiver/exciter 14, and power supply 16 serve the same functions as in a conventional mechanically scanned airborne radar system, such as an APG-65 (F/A-18) radar system, for example.

For the purposes of completeness, the radar data processor 12 may comprise part numbers 3525044 and 3525032 manufactured by the assignee of the present invention. The power supply 16 may be comprised of part number 3525610 manufactured by the assignee of the present invention. The analog signal converter 13 may be comprised of part number 3525038 manufactured by the assignee of the present invention. The transmitter 15 may be comprised of part number 3525111 manufactured by the assignee of the present invention. The receiver/exciter 14 may be comprised of part number 3525025 manufactured by the assignee of the present invention. The above components are employed in the APG-65 radar system. The continuous transverse stub antenna array 17 is described in the above-cited patent application.

Figure 2:
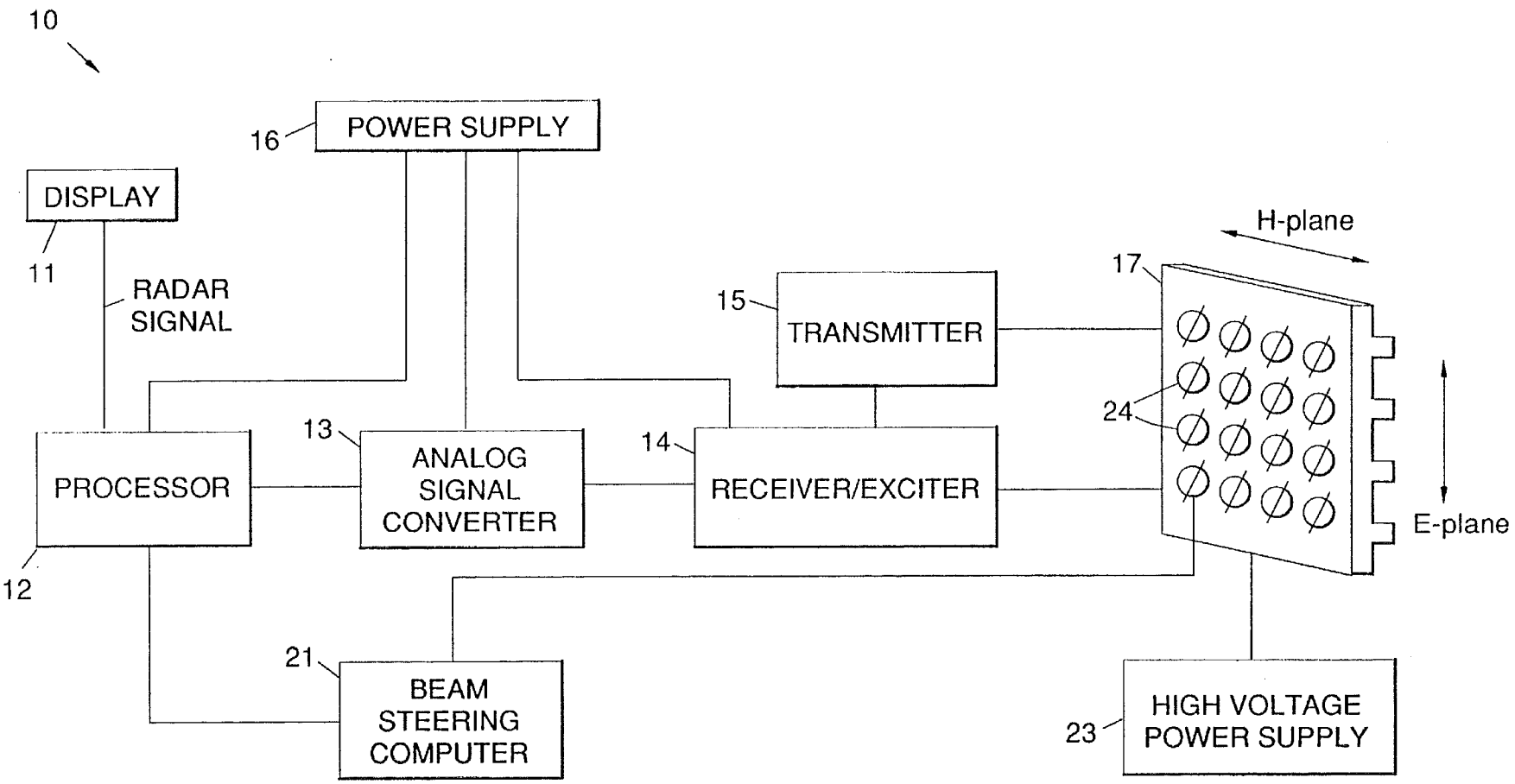
FIG. 2 shows the configuration of a radar subsystem using a voltage variable dielectric continuous transverse stub antenna to form a continuous transverse stub electronically scanned passive array radar system.

FIG. 2 shows the configuration of a radar system using a voltage variable dielectric continuous transverse stub antenna array 17 to form a continuous transverse stub electronically scanned radar system 10. In FIG. 2, a high voltage power supply 23 is used to electronically steer the continuous transverse stub antenna array 17 in the E-Plane, (perpendicular to the direction of the stubs). A beam steering computer 21 is used to set the phase-shifters 24 to steer the beam in the H-Plane to a desired pointing angle. This system 10 provides for two-dimensional electronic scanning of the continuous transverse stub antenna array 17. The continuous transverse stub array 17 depicted in FIG. 2 is only a representation of a complete system. The actual array has many functional layers as will be described with reference to FIG. 4.

Figure 3:
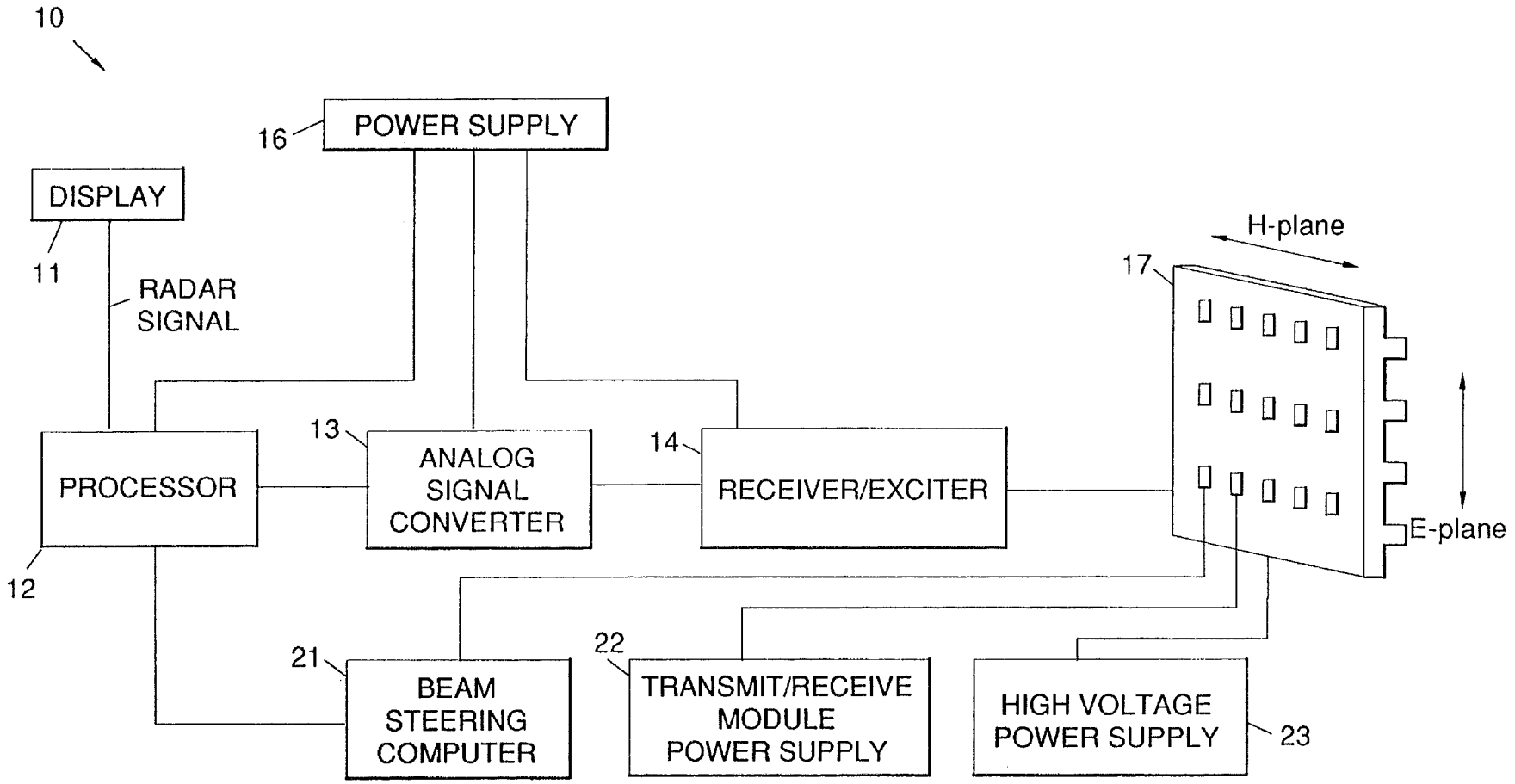
FIG. 3 shows the configuration of a radar subsystem using a voltage variable dielectric continuous transverse stub antenna to form a continuous transverse stub active array radar system.

FIG. 3 shows the configuration of a radar system using a voltage variable dielectric continuous transverse stub antenna array 17 to form a continuous transverse stub active array radar system 10. In FIG. 3, the transmit/receive module power supply 22 is used to power the transmit/receive modules 27, the high voltage power supply 23 is used to steer the continuous transverse stub antenna array 17 in the E-Plane, perpendicular to the stub direction. The beam steering computer 21 is used to set the phase-shifters 24 internal to the transmit/receive modules 27 to steer the beam in the H-Plane to a desired pointing angle. This system 10 provides for two-dimensional electronic scanning of the continuous transverse stub antenna array 17. The continuous transverse stub antenna array depicted in FIG. 3 is described with reference to FIG. 4.

Figure 4:
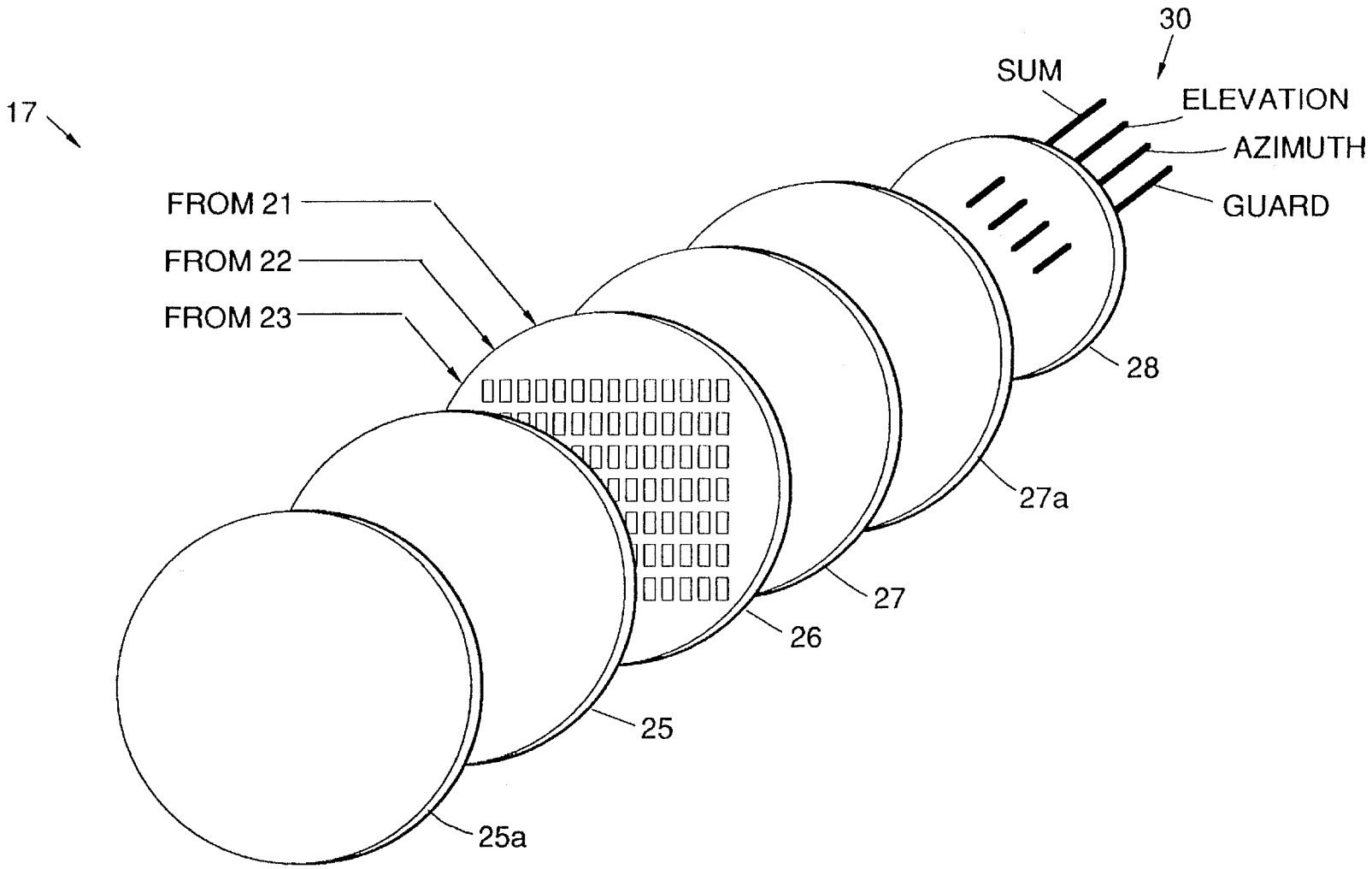
FIG. 4 shows an exploded view of the continuous transverse stub active array showing the typical functional layers.

FIG. 4 shows an exploded view of the continuous transverse stub active array 17 showing its typical functional layers. These layers include a continuous transverse stub radiating plate 25*a*, a cold plate 25 attached to the radiating plate 25*a*, a plurality of transmit and receive modules 26 that include an air stripline feed 27 are coupled to the continuous transverse stub radiating plate 25, a power filter and distribution circuit 27*a* (printed wiring board) is coupled to the plurality of transmit and receive modules 26, and a monopulse network 28. Such components are generally well-known in the art. Signal outputs from the continuous transverse stub active array 17 are provided by signal leads 30 that provide a sum signal, an elevation signal, an azimuth signal, and a guard signal as output signals therefrom.

A complete understanding of the continuous transverse stub active array 17 may be had with reference to copending U.S. patent application Ser. No. 07/751,282, filed Aug. 29, 1991, assigned to the assignee of the present invention, the contents of which are incorporated herein by reference. This patent application describes the continuous transverse stub array 17 in great detail and shows a multitude of variations in its design that may be employed in different radar systems 10, depending upon the particular application.

The continuous transverse stub antenna array 17 may be used passively as a radar warning receiver or ESM antenna to provide situation awareness and early warning with respect to RF emitters. The continuous transverse stub antenna array 17 has the capability to provide multi-octave RF coverage and dual polarization switching suitable for a wideband radar warning receiver or electronic support measures. The dual polarization switching capability can provide detection of RF emitters with different polarization. Highly accurate direction of arrival information may be obtained by feeding a reduced number of elements in the continuous transverse stub antenna array 17. Accurate direction of arrival information greatly enhances the capability of the radar warning receiver in resolving multiple targets in the same quadrant. In addition, elements of the continuous transverse stub antenna array 17 may be designed to perform passive ranging functions of an interferometer. Passive ranging capability allows an aircraft to passively determine the range to the emitter without activating its own radar and alerting its own location to others. The light weight, low depth and conformal capability of the continuous transverse stub antenna array 17 allows placement of antennas on previously unavailable places on an aircraft or other platform.

The continuous transverse stub antenna array 17 is inherently wideband and the dielectric material from which it is made responds rapidly to provide sequential jamming of multiple RF emitters. The light weight, low depth, conformal capability of the continuous transverse stub antenna array 17 allows airborne platforms to have all-aspect jamming capability which enhances survivability.

The present invention thus provides continuous transverse stub antenna arrays 17 combined with conventional radar subsystem to form improved radar systems 10. When the continuous transverse stub antenna array 17 is fabricated from voltage variable dielectric material, the radar system 10 forms either a passive one- or two-dimensional passive electronically scanned antenna radar system. When active array transmit/receive modules are used in conjunction with the voltage variable dielectric continuous transverse stub antenna array 17, it forms a two-dimensional active array radar system 10.

The elements of the radar system 10 used in the present invention are substantially identical to those employed in a conventional passive electronically scanned radar subsystem, but with the addition of the high voltage power supply 23 needed to drive the voltage variable dielectric material to achieve beam scanning. Similarly, the high voltage power supply 23 is the only addition to a conventional active array radar system needed when a continuous transverse stub active antenna array 17 is used in place of a conventional active array.

The continuous transverse stub antenna array 17 has lower cost, is lighter, has smaller depth, and typically requires less prime power and cooling than the equivalent conventional antenna subsystems (i.e., non-scanning, passive electronically scanned antenna, or active array) having the same size aperture. It also may be configured into a very effective but simple frequency scanning antenna array 17. In addition, the voltage variable dielectric continuous transverse stub antenna 17 may be made conformal to singly or doubly curved surfaces and therefore may be made to fit in areas of an aircraft that are typically inaccessible to conventional electronically scanned antennas or active array antennas. In practice, the voltage variable dielectric continuous transverse stub antenna array 17 may be the only currently known antenna architecture that provides practical electronic scanning capability at very high RF frequencies (greater than 60 GHz).

Many of the advantages of the continuous transverse stub electronically scanned antenna array 17 and the continuous transverse stub active array accrue from the phase shifting capability of the voltage variable dielectric material used to fabricate the antenna array 17. This removes the conventional grating-lobe-elimination constraint that normally requires that discrete phase shifters or transmit/receive modules be spaced nominally every one-half wavelength in a two-dimensional grid over the surface of the array. The continuous transverse stub antenna array 17 requires discrete phase shifters 24 in only one dimension. The number and spacing of the rows or columns of phase shifters 24 for a continuous transverse stub electronically scanned antennas depends on the required power-aperture, instantaneous-bandwidth, and insertion loss of the radar system 10. Typically there is from 10–25% of the number of discrete phase shifters 24 or transmit/receive modules 27 on a continuous transverse stub electronically scanned antenna 17 or active array 17 compared to conventional antenna architectures. Cost advantages also accrue from the extremely simple geometry of the continuous transverse stub antenna array 17 and the ceramic and plastic materials from which the antenna array 17 is fabricated, both of which permit very low manufacturing costs.

Continuous transverse stub antenna arrays 17 employed in the present invention may be designed to operate at almost any RF frequency. Tunable bandwidths for a continuous transverse stub electronically scanned antenna arrays 17 or continuous transverse stub active array 17 are typically forty percent of the center frequency. The present invention may be employed with any aircraft radar, shipborne target tracking radar systems, particularly those with mast-mounted antennas, and ground-based target tracking radar systems. Commercial applications include adaptive cruise control radar systems and landing aid radar systems. The continuous transverse stub antenna array 17 may be used passively as a radar warning receiver or electronic support measures antenna to provide situation awareness and early warning of RF emitters.

The continuous transverse stub antenna array 17 has the capability to provide multi-octave RF coverage and dual polarization switching suitable for a wideband radar warning receiver or electronic support measures (electronic warfare applications). Dual polarization switching capability can provide detection of RF emitters with different polarization. Highly accurate direction of arrival information may be obtained by feeding a reduced number of elements in the continuous transverse stub antenna array 17. Accurate direction of arrival information greatly enhances a radar warning receiver's capability in resolving multiple targets in the same quadrant. In addition, elements of the continuous transverse stub antenna array may be designed to perform passive ranging functions of an interferometer. Passive ranging capability allows an aircraft to passively determine the range to the emitter without activating its own radar and alerting its own location to others. The light weight, low depth and conformal capability of the continuous transverse stub antenna allows placement of antennas on previously unavailable places on the platform.

Thus there has been described new and improved radar and electronic warfare systems employing continuous transverse stub antenna arrays. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A radar system comprising:

a continuous transverse stub antenna array;

a transmitter coupled to the continuous transverse stub antenna array;

a receiver/exciter coupled to the transmitter and the continuous transverse stub antenna array;

an analog signal converter coupled to the receiver/exciter;

a radar display;

a processor coupled to the analog signal converter and radar display for processing received radar return signals to produce a radar image that is displayed on the display; and a power supply coupled to the processor, the analog signal converter, and the receiver/exciter for providing operational power thereto.

2. The radar system of claim 1 wherein the continuous transverse stub array is substantially immobile.

3. The radar system of claim 1 wherein the continuous transverse stub array is mechanically scanned.

4. The radar system of claim 1 that comprises an electronically scanned radar system wherein the continuous transverse stub array is comprised of voltage variable dielectric material, and wherein the radar system further comprises:

a plurality of discrete phase shifters coupled to the continuous transverse stub antenna array;

a beam steering computer coupled between the signal processor and the continuous transverse stub antenna array for setting the phase shifters to steer a radar beam produced by the antenna array in the H-Plane to a desired pointing angle; and a high voltage power supply coupled to the continuous transverse stub antenna array for steering the radar beam produced by the antenna array continuous transverse stub antenna array in its E-Plane.

5. An active array radar system comprising:

a continuous transverse stub antenna array that is comprised of voltage variable dielectric material;

a receiver/exciter coupled to the continuous transverse stub antenna array;

an analog signal converter coupled to the receiver/exciter;

a radar display;

a processor coupled to the analog signal converter and radar display for processing received radar return signals to produce a radar image that is displayed on the display;

a power supply coupled to the signal processor, the analog signal converter, and the receiver/exciter for providing operational power thereto.

a plurality of transmit and receive modules that comprise discrete phase shifters coupled to the continuous transverse stub antenna array;

a beam steering computer coupled between the signal processor and the continuous transverse stub antenna array for setting the phase shifters to steer a radar beam produced by the antenna array in the H-Plane to a desired pointing angle;

a transmit and receive module power supply coupled to the continuous transverse stub antenna array for exciting the plurality of discrete phase shifters; and a high voltage power supply coupled to the continuous transverse stub antenna array for steering the radar beam produced by the antenna array continuous transverse stub antenna array in its E-Plane.

6. The radar system of claim 5 wherein the continuous transverse stub array comprises a plurality of layers that comprise:

a continuous transverse stub radiating plate;

a cold plate attached to the continuous transverse stub radiating plate;

a plurality of transmit and receive modules that include an air stripline feed coupled to the continuous transverse stub radiating plate;

a power filter and distribution circuit coupled to the plurality of transmit and receive modules; and a monopulse network for providing signal outputs that include a sum signal, an elevation signal, an azimuth signal, and a guard signal.

7. The radar system of claim 6 wherein the continuous transverse stub radiating plate comprises ceramic material.

* * * * *